US005369896A

United States Patent [19]

Frachey et al.

[11] Patent Number: 5,369,896

[45] Date of Patent: * Dec. 6, 1994

[54] SPORTS SHOE INCORPORATING AN ELASTIC INSERT IN THE HEEL

[75] Inventors: Enrico Frachey, Ponderano; Alfredo Crespan, Mignagola di Carbonera, both of Italy

[73] Assignee: Fila Sport S.p.A., Vercelli, Italy

[ * ] Notice: The portion of the term of this patent subsequent to Mar. 3, 2009 has been disclaimed.

[21] Appl. No.: 24,833

[22] Filed: Mar. 1, 1993

Related U.S. Application Data

[63] Continuation of Ser. No. 807,512, Dec. 16, 1991, abandoned, which is a continuation of Ser. No. 527,876, May 24, 1990, Pat. No. 5,092,060.

[30] Foreign Application Priority Data

May 24, 1989 [IT] Italy ..... 20614 A/89

[51] Int. Cl.[5] ..... A43B 13/18; A43B 21/26

[52] U.S. Cl. ..... 36/29; 36/28; 36/114

[58] Field of Search ..... 36/28, 29, 31, 35 R, 36/37, 27, 35 B, 114, 38, 71

[56] References Cited

U.S. PATENT DOCUMENTS

| | | | |
|---|---|---|---|
| 74,912 | 2/1868 | Hadley . | |
| 456,677 | 7/1891 | McIntyre | 36/3 B |
| 536,590 | 3/1895 | Tillgren | 36/3 B |
| 1,559,532 | 10/1925 | Smith . | |
| 1,598,809 | 9/1926 | Dressel | 36/28 |
| 1,605,408 | 11/1926 | Huiskamp | 36/3 B |
| 1,605,588 | 11/1926 | Huiskamp | 36/3 R |
| 1,981,300 | 11/1934 | Berg | 36/3 B |
| 2,146,888 | 6/1938 | Fisch . | |
| 3,253,355 | 5/1966 | Menken | 36/29 |
| 4,187,620 | 2/1980 | Selner . | |
| 4,219,945 | 9/1980 | Rudy | 36/29 |
| 4,297,797 | 11/1981 | Meyers | 36/29 |
| 4,319,412 | 3/1982 | Muller et al. . | |
| 4,364,186 | 12/1982 | Fukuoka | 36/29 |
| 4,391,048 | 7/1983 | Lutz | 36/28 |
| 4,417,407 | 11/1983 | Fukuoka . | |
| 4,446,634 | 5/1984 | Johnson . | |
| 4,462,171 | 7/1984 | Whispell | 36/29 |
| 4,472,890 | 9/1984 | Gilbert | 36/29 |
| 4,535,553 | 8/1985 | Derderian et al. | 36/28 |
| 4,546,555 | 10/1985 | Spademan . | |
| 4,608,768 | 9/1986 | Cavanagh . | |
| 4,616,431 | 10/1986 | Dassler . | |
| 4,631,843 | 12/1986 | Annovi . | |
| 4,768,295 | 9/1988 | Ito | 36/29 |
| 4,783,910 | 11/1988 | Bods, II et al. | 36/35 R |
| 4,794,707 | 1/1989 | Franklin et al. | 36/31 |

(List continued on next page.)

FOREIGN PATENT DOCUMENTS

| | | | |
|---|---|---|---|
| 77203615 | 4/1988 | China . | |
| 77206424 | 7/1988 | China . | |
| 0215995 | 4/1987 | European Pat. Off. | 36/29 |
| 806647 | 7/1949 | Germany | 36/29 |
| 3338557 | 5/1985 | Germany . | |
| 601627 | 5/1948 | United Kingdom . | |
| 22983 | 10/1989 | Uruguay . | |

OTHER PUBLICATIONS

Autry Shox Walker Publication, Oct. 17, 1988.
Adidas Catalog, Aug. 1986.

*Primary Examiner*—Steven N. Meyers
*Attorney, Agent, or Firm*—Oblon, Spivak, McClelland, Maier & Neustadt

[57] ABSTRACT

A sports shoe having a vamp and a lower support part which includes a sole, and a wedge arranged on said sole, a mounting insole an additional insole, which is in contact with the user's foot. The shoe includes, associated with the lower support part, an insert including elements which are elastically deformable under pressure and which are enclosed in an airtight casing advantageously of a plastic material, the insert being arranged in a seat provided in the wedge and in the mounting insole in a position corresponding with the heel of the foot. A further insert may be provided at a different location in the shoe.

6 Claims, 3 Drawing Sheets

U.S. PATENT DOCUMENTS

| | | | |
|---|---|---|---|
| 4,815,221 | 3/1989 | Diaz | 36/28 |
| 4,817,304 | 4/1989 | Parker et al. | 36/114 |
| 4,843,741 | 7/1989 | Yung-Mao . | |
| 4,845,863 | 7/1989 | Yung-Mao . | |
| 4,874,640 | 10/1989 | Donzis | 36/37 |
| 4,887,367 | 12/1989 | Mackness et al. | 36/29 |
| 4,908,962 | 3/1990 | Yung-Mao | 36/28 |
| 4,918,838 | 4/1990 | Chang | 36/29 |
| 4,918,838 | 4/1990 | Chang | 36/29 |
| 4,924,605 | 5/1990 | Spademan . | |
| 4,956,927 | 9/1990 | Misguch et al. | 36/28 |
| 4,970,807 | 11/1990 | Anderie et al. | 36/28 |
| 5,025,575 | 6/1991 | Lakic . | |
| 5,067,256 | 11/1991 | Darby | 36/71 |
| 5,074,765 | 12/1991 | Pekar . | |
| 5,086,574 | 2/1992 | Bacchiocchi | 36/28 |
| 5,092,060 | 3/1992 | Frachey et al. | 36/29 |
| 5,152,083 | 10/1992 | Gagne . | |

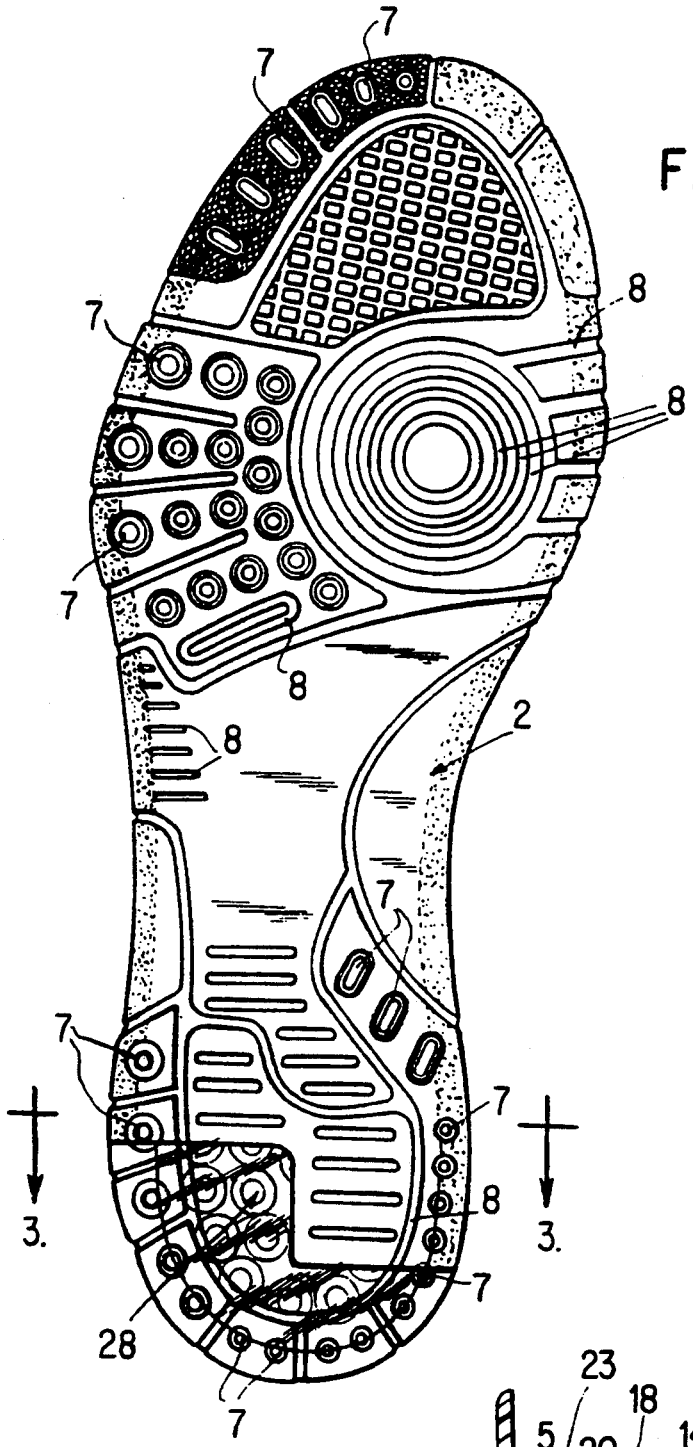
FIG. 2
FIG. 3
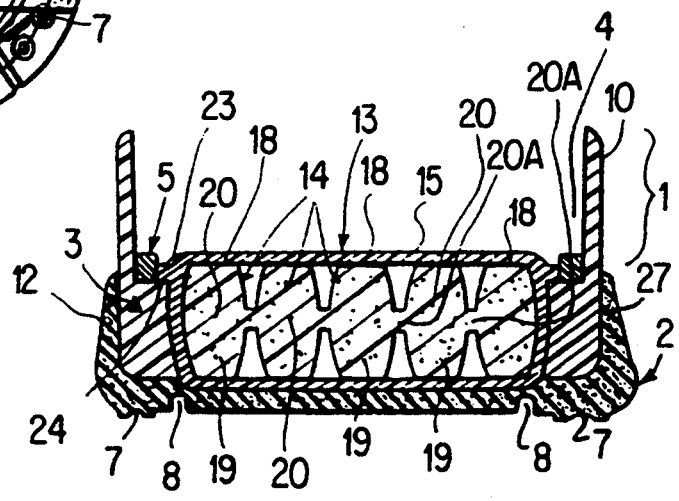

SPORTS SHOE INCORPORATING AN ELASTIC INSERT IN THE HEEL

This application is a continuation of application Ser. No. 07/807,512, filed on Dec. 16, 1991 now abandoned, which is a continuation of U.S. Ser. No. 07/527,876, filed May 24, 1990, now U.S. Pat. No. 5,092,060.

BACKGROUND OF THE INVENTION

1. Field of the Invention

This invention relates to a sports shoe consisting of a vamp and a lower support part comprising a sole, and a wedge arranged on said sole and housing, mutually superposed, a mounting insole and a further insole which is in contact with the user's or athlete's foot during use of the shoe.

2. Discussion of the Background

For some years there has been a requirement for sports shoes during use to be able to return to the user, in the form of a thrust force, a part of the energy which has been transferred to the ground by the movement of the user, so as to facilitate lifting of the foot and thus make this movement easier to accomplish.

A particular requirement is for sports shoes of this type which:

(a) provide practically total damping of the impact derived from the leap which the user and especially the athlete executes during running, thus protecting his osseous and joint structure;

(b) optimize the position of the user's foot as he bears down on it, thus preventing the osseous structure from undergoing any type of deformation; and (c) corrects the pronation and supination defects of each user.

There are already various known constructions which attempt to satisfy the aforesaid requirements. One of these, for example, comprises an air cushion positioned in the lower support part of the shoe and of dimensions substantially equal to those of the wedge, i.e. an air cushion located along the entire length of the foot. Another construction comprises an insole provided over its entire lower surface with elements projecting towards the wedge, and yet another construction comprises a honeycomb structure arranged to correspond with the heel of the shoe.

All of these constructions have drawbacks which cannot be ignored. For example, the manufacture of a shoe provided with an air cushion is expensive and in any event does not completely satisfy the aforesaid requirements. In this respect, although an air cushion positioned along the entire length of the foot on the one hand results in a very comfortable shoe, it does not, on the other hand, exert the required thrust on the foot. In addition, the air cushion cannot confer a good multidirectional stability and flexibility to the shoe.

Although the other shoe constructions mentioned above provide good comfort to the user's foot, they do not properly attain the stated objects. Other shoe constructions are known which on one hand at least partly satisfy the aforesaid requirements, but on the other hand are of such high cost as to put them beyond the means of that large mass of purely amateur users who indulge in jogging.

SUMMARY OF THE INVENTION

An object of the present invention is therefore to provide a sports shoe which satisfies the aforesaid requirements and which more particularly enables a large part of the thrust transmitted by the user to the ground to be retransmitted to the user's foot. A further object is to provide a sports shoe which does not penalize the thrust action exerted by the user on the front part of the shoe, and which has multidirectional stability and flexibility.

These and further objects which will be apparent to one of ordinary skill in the art are attained by a sports shoe of the aforesaid type, characterized by including, associated with the lower support part, at least an insert comprising elements which are elastically deformable under pressure and are enclosed in an airtight casing advantageously of plastic material, said insert being arranged in a seat between a wedge and a mounting insole, in a position corresponding with the heel of the foot.

The seat is preferably provided in the wedge and is closed by the superimposed mounting insole.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 is a bottom view of the sports shoe according to the invention;

FIG. 3 is a sectional view taken along line III—III of FIG. 2; and

DESCRIPTION OF THE PREFERRED EMBODIMENT

Figure 1:
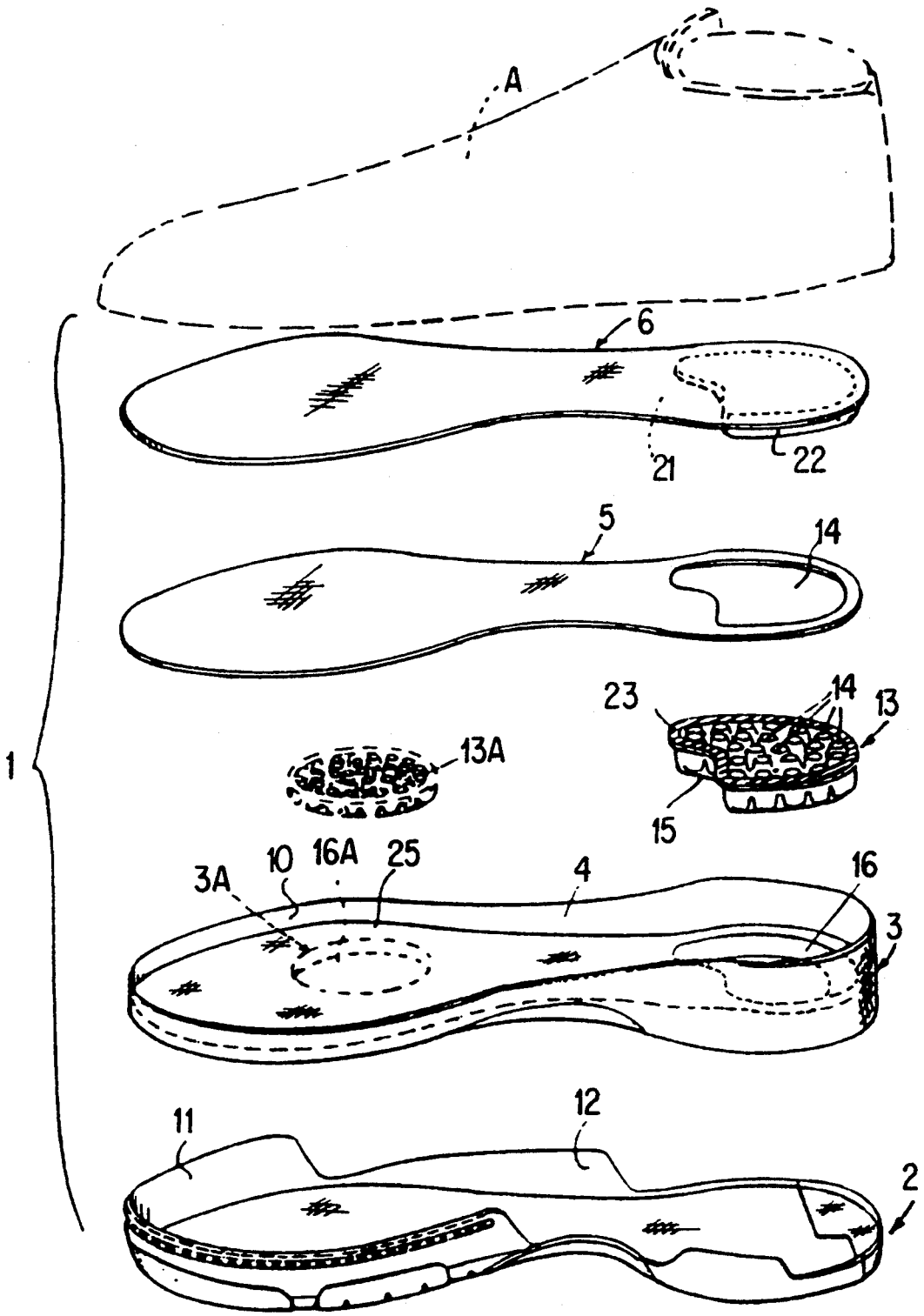
FIG. 1 is an exploded view of the lower support part of a sports shoe according to the invention.

With reference to the figures, the sports shoe of the invention comprises a vamp A and a lower support part 1 comprising a sole 2, for example of synthetic rubber, to which a wedge 3, for example of thermoplastic polyurethane, is fixed in a known manner. The wedge comprises a recess 4, bounded by a raised edge 10, carrying a mounting insole 5, for example of cork, on which there is positioned a further insole 6, for example of fabric (not shown in FIG. 3). The sole 2, constructed advantageously of rubber, comprises the usual notches 7 and incisions or recessed portions 8 in its lower surface. It also comprises a front raised edge 11, and a lateral edge 12 which extends along the entire remaining perimeter of the sole.

According to the invention, in the lower part of the shoe there is arranged an insert 13 comprising elastically deformable elements 14 of substantially similar height and diameter and made of thermoplastic material enclosed in an air-tight casing 15 constructed of plastic material such as polyurethane or a similar material. As shown in FIG. 3, the elements extend vertically throughout substantially the entire height dimension of the heel portion of the shoe. In casing 15 there is present air that has a pressure less than or equal to atmospheric pressure. In this example, the insert 13 is positioned in seats 16 and 17 provided in the wedge 3 and in the insole 5 respectively, said seats being superposed.

Alternatively, seat 17 can be omitted with insert 13 located only in seat 16 of wedge 3, so that the insole 5 is superimposed and covers seat 16.

More specifically, the elements 14 of the insert 13 are formed by molding any synthetic high-elasticity material and are substantially barrel-shaped, i.e., they are tapered at their opposing free ends 18 and 19 and have their major cross-section substantially in the central region 20 in which said elements are joined together by an integral bridging portion 20A. Due to manufacturing requirements of insert 13, free ends 18, 19 of barrel-shaped elements 14 are fastened to casing 15. This is actually the preferred embodiment of insert 13, wherein in a first phase, elements 14 are obtained by means of molding; subsequently they are encased inside thermo-soldering plastic sheets which constitute casing 15; the elements 14 are encased by sheets when they are at a relatively high temperature so that a welding of free ends 18, 19 of elements 14 with the sheets occurs. The connection between casing 15 and the barrel-shaped elements has the advantage of anchoring said elements inside said casing, thereby preventing the casing and barrel-shaped elements from moving during use of the shoe according to the invention and so contributing together with the mutual connection of the barrel-shaped elements 14 to the good multidirectional stability and flexibility of the resulting shoe. This affords a greater stability for insert 13 within the shoe, and permits better performance of the function for which it is intended, which functions will be further defined below.

The shape of the elements 14, as shown and described by way of example, allows considerable absorption of the stresses caused by the user's foot as he moves, and at the same time allows a large part of the absorbed energy to be retransmitted rapidly but gradually to the foot.

In order to secure the insert 13 within the seats 16 and 17, the insole 6 comprises on that face 21, facing the insole 5, a projection 22 of a shape corresponding to said seats and arranged to cooperate with them and with the insert 13. In the alternative embodiment recited above, the projection 22 can be omitted.

The casing 15 of insert 13 comprises a flange 23 which, when the insert 13 has been positioned in the lower part 1 of the shoe, rests on a step 24 provided between the insole 5 and an inner surface 25 of the wedge 3. In the alternative, where the hole or seat 17 is omitted, the flange 23 (very thin) rests on the contour of the wedge seat 16.

Finally, the sole comprises a reinforcement element 28 positioned below the insert 13 or in other positions of the sole where others inserts may be located, said reinforcement element 28 being formed, for example, of plastic material e.g. of natural or synthetic rubber and being advantageously somewhat transparent. Element 28 may or may not be tinted. Reinforcing element 28 is of a wear and abrasion resistant material and is preferably located in the heel portion and in the metatarsal portion of the sole.

During the use of a shoe according to the invention, each time the user presses the lower part 1 of the shoe with his foot, the insert 13 is pressed towards the sole 2. Specifically, the pressing action exerted by the foot depresses the elements 14 which deform and increases the pressure within the airtight casing 15 which is constricted by the surrounding wall portion of its seat. When the user's heel ceases its pressing action, the elements 14 return to their initial configuration, so as to transmit a large part of the energy acquired during the pressing action to the user's foot, which therefore receives a gradual thrust as his heel (or other part of the foot, e.g. the metatarsal one) separates from the ground. To said thrust, exerted on the user's foot by elements 14, there must be added the thrust exerted by the air which is present inside insert 13, this air being under pressure due to the action by the user's foot. These combined thrusts help transfer to the user's foot part of the energy transmitted by the user to the ground during movement.

Elastic inserts like the one disclosed above can be located in the other regions of the support part 1, in particular in proximity to the frontal region of the sole 2 and wedge 3 and more particularly in the metatarsal zone 3A as shown in dotted lines in FIG. 1, where the seat is referenced by 16A and the insert by 13A, thus allowing the user (particularly an athlete) to obtain increased pickup during acceleration or during changes in the rate of movement.

Figure 4:
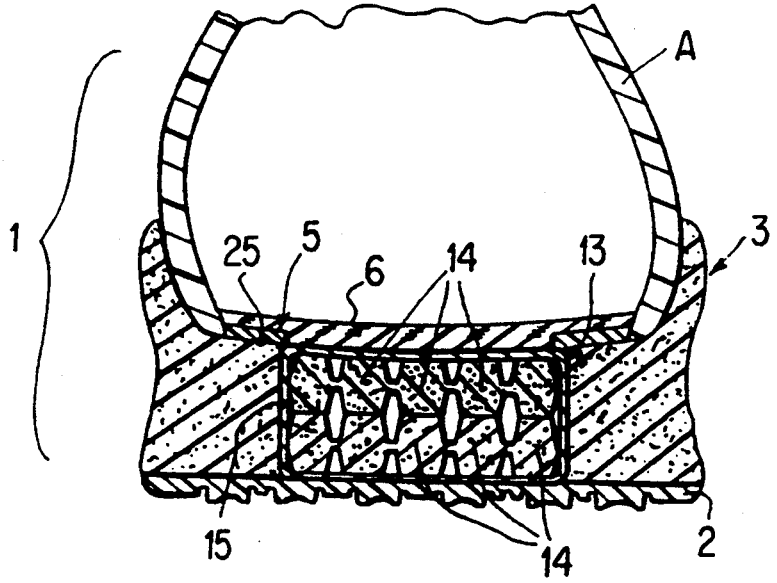
FIG. 4 is a sectional view of an alternate embodiment
Figure 1:
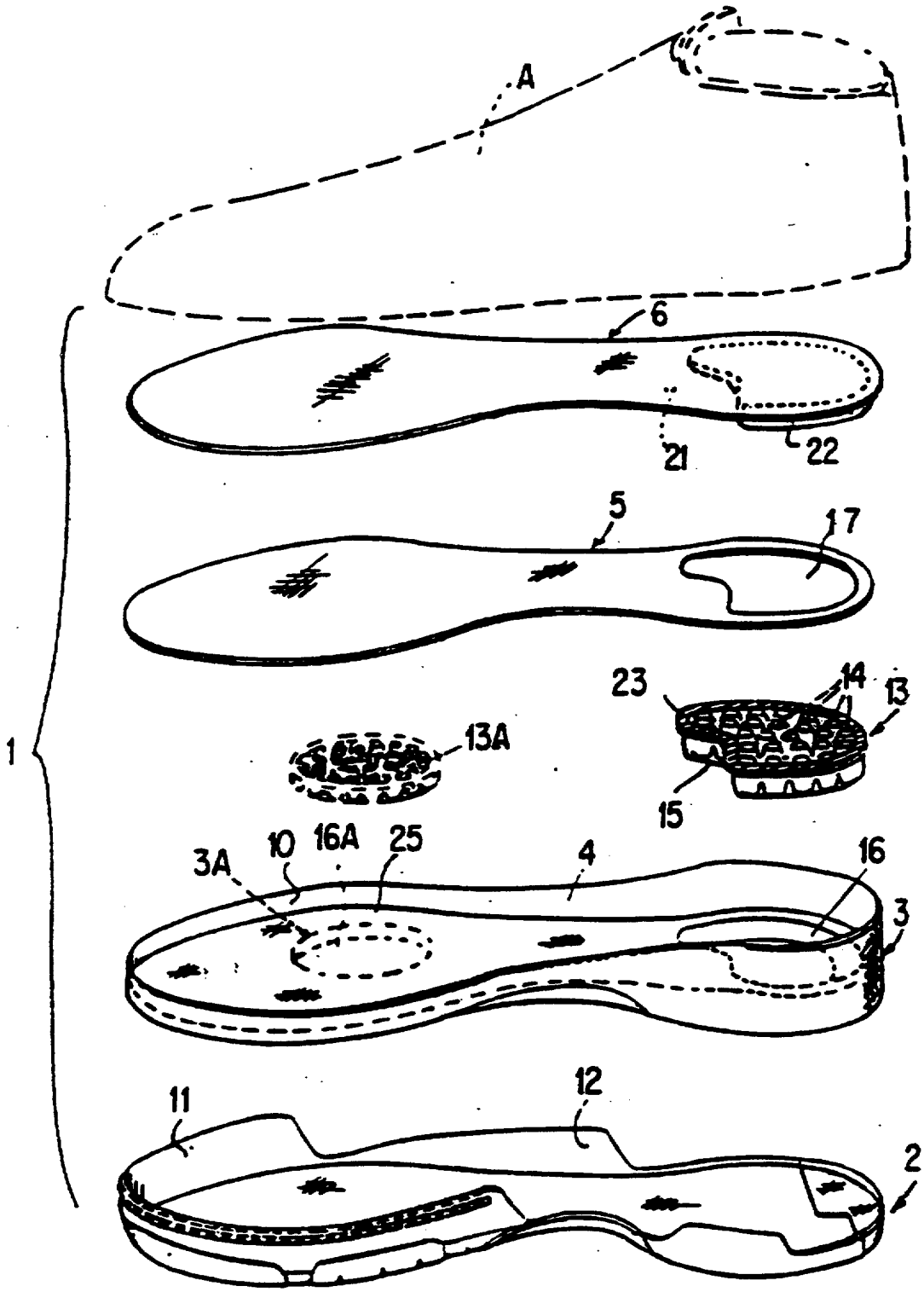

The insert 13 shown in FIG. 1 and 3 comprises only one layer of elements 14; however, there can be provided an insert 13 having two or more layers of elements 14 superimposed as shown in FIG. 4. In particular, if the above cited insert has two layers of elements 14, a first layer supports the second whose deformable elements rest on the elements positioned below.

This further permits an improvement in the return of part of the energy (passed on by the user to the ground) to the foot of the user. It must be noted that, in the same manner previously described, free ends 18, 19 of barrel-shaped element 14, are fastended to (or soldered on) casing 15, whereas the contact surfaces of the two layers of element 14, if used, would be fastened to (or soldered on) each other. This affords stability for insert 13, preventing one of the layers from sliding over the other one within casing 15. A shoe constructed in accordance with the invention satisfies the aforesaid requirements and in particular enables most of the energy expended during movement to be retransferred to the foot.

Obviously, numerous modifications and variations of the present invention are possible in light of the above teachings.

One of these different embodiments of the present invention is shown by dotted line in FIG. 1; this embodiment comprises an additional insert 13A located in seat 16A provided in metatarsal area 3A of wedge 3.

Also, insert 13A can comprise one or more layers of interconnected barrel-shaped elements 14.

It is therefore to be understood that within the scope of the appended claims, the invention may be practiced otherwise than as specifically described herein; in particular, other than insert 13 positioned in the heel area 33 of wedge 3, the invention can comprise another insert positioned in properly selected areas of said wedge (such as the arch area), said insert(s) being similar to insert 13.

What is claimed as new and desired to be secured by Letters Patent of the United States is:

1. A sports shoe which comprises:

a vamp;

a lower support part connected to said vamp and which comprises a substantially flat sole and an insole for contacting a user's foot;

at least one insert mounted in said lower support part so as to form at least part of a heel portion of the shoe and which includes a plurality of elements which are substantially uniformly spaced from one another, are of substantially equal height, diameter and shape and which are elastically deformable wherein said elastically deformable elements extend vertically throughout substantially the entire height dimension of the heel portion of the shoe, are shaped such that substantially all horizontal plane cross sections of said elastically deformable elements taken along a longitudinal axis of the shoe are of a substantially circular outer circumference and wherein said lower support part includes a downwardly extending projection which extends toward said insert; and a bridging member lying in a single substantially horizontal plane for interconnecting said plurality of elements.

2. A shoe as claimed in claim 1, which consists of a single casing located within a heel portion of said lower support part within which said insert is positioned.

3. A sports shoe which comprises:

a vamp;

a lower support part connected to said vamp and which comprises a substantially flat sole, a wedge connected to said sole and housing, mutually superposed, a mounting insole, an insole for contacting a user's foot, and a seat provided in said wedge;

at least one insert mounted in said lower support part so as to form at least part of a heel portion of the shoe and which includes a plurality of elements which are substantially uniformly spaced from one another, are of substantially equal height, diameter and shape and which are elastically deformable, wherein said elements extend throughout substantially the entire height dimension of the heel portion of the shoe and are shaped such that substantially all horizontal plane cross sections thereof taken along a longitudinal axis of the shoe have a substantially circular outer circumference, said insert being positioned in said seat in a position for being opposed to a heel of the foot of a user and wherein said insole for contacting the user's foot comprises a face portion facing said mounting insole and a projection of a shape corresponding to the shape of said seat in which the insert is positioned; and a bridging member lying in a single substantially horizontal plane for interconnecting said plurality of elements, 4. A support shoe which comprises:

a vamp;

a substantially flat lower support part connected to said vamp;

at least one insert mounted in said lower support part and which includes a plurality of elements extending throughout substantially the entire height dimension of the heel portion of the shoe and which are of substantially equal height, diameter and shape wherein said elements are enclosed within a single casing located in a heel portion of the shoe and are elastically deformable and wherein said elastically deformable elements are substantially uniformly space from one another, are shaped such that substantially all horizontal cross sections of said elastically deformable elements taken along a longitudinal axis of the shoe are of a substantially circular outer circumference and form at least part of the heel portion of the shoe; and a bridging member lying in a single substantially horizontal plane of said lower support part for interconnecting said plurality of elements.

5. A support shoe which comprises:

a vamp;

a lower support part connected to said vamp and which comprises a substantially flat sole and an insole in contact with said sole;

at least one insert mounted in said lower support part so as to form at least part of a heel portion of the shoe and which includes a plurality of elements extending throughout substantially the entire height dimension of the heel portion of the shoe, wherein said elements are of substantially equal height and diameter and are enclosed within a single casing within the heel portion of the shoe and are elastically deformable, said elements being substantially uniformly spaced from one another, being shaped such that substantially all horizontal plane cross sections thereof taken along a longitudinal axis of the shoe are of a substantially circular outer circumference, said insert being positioned in said seat in a position for being opposed to a heel of the foot of the user and forming at least part of a heel portion of the shoe; and a bridging member lying in a single substantially horizontal plane of said lower support part for interconnecting said plurality of elements.

6. A support shoe which comprises:

a vamp;

a lower support connected to said vamp and which comprises a substantially flat sole and an insole connected to said sole, the insole having a projection extending therefrom;

at least one insert mounted in said lower support part between said sole and said insole so as to form a part of a heel portion of said shoe and which includes a plurality of substantially uniformly Spaced elements which are of substantially equal height, diameter and shape and which are elastically deformable, said elements extending vertically throughout substantially the entire height dimension of the heel portion and being shaped such that substantially all horizontal plane cross sections of said elements taken along a longitudinal axis of the shoe are of a substantially circular outer circumference, said insert being positioned in said seat at a position opposed to a heel of a foot of a user wherein said insole comprises a face portion contacting a user's foot and wherein said projection extends toward said insert; and a bridging member lying in a single substantially horizontal plane of said lower support part for interconnecting said plurality of elements.

* * * * *

UNITED STATES PATENT AND TRADEMARK OFFICE

CERTIFICATE OF CORRECTION

PATENT NO. : 5,369,896

DATED : December 6, 1994

INVENTOR(S) : Enrico FRACHEY, et al.

It is certified that error appears in the above-indentified patent and that said Letters Patent is hereby corrected as shown below:

On the title page, Item [73], the Assignee should read:

--Global Sports Technologies, Inc., Tortolla, British Virgin Islands--

Signed and Sealed this

Fifteenth Day of August, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,369,896

DATED : December 6, 1994

INVENTOR(S) : Enrico Frachey et al

It is certified that error appears in the above-identified patent and that said Letters Patent is hereby corrected as shown below:

In the drawings: Fig. 1 should be deleted and replaced with the attached fig. 1.

Signed and Sealed this

Tenth Day of September, 1996

*Attest:*

Bruce Lehman

BRUCE LEHMAN

*Attesting Officer*

*Commissioner of Patents and Trademarks*